US009447546B2

(12) United States Patent
Goulet et al.

(10) Patent No.: US 9,447,546 B2
(45) Date of Patent: Sep. 20, 2016

(54) TWO SIDED MULTI-PLY TISSUE PRODUCT

(71) Applicant: Kimberly-Clark Worldwide, Inc., Neenah, WI (US)

(72) Inventors: Mike Thomas Goulet, Neenah, WI (US); Elizabeth Oriel Bradley, Neenah, WI (US); Geoffrey Fenn Carlow, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 27 days.

(21) Appl. No.: 14/401,429

(22) PCT Filed: Jan. 24, 2014

(86) PCT No.: PCT/US2014/012856

§ 371 (c)(1),
(2) Date: Nov. 14, 2014

(87) PCT Pub. No.: WO2015/112155

PCT Pub. Date: Jul. 30, 2015

(65) Prior Publication Data

US 2016/0002861 A1 Jan. 7, 2016

(51) Int. Cl.

| | |
|---|---|
| ***D21H 27/30*** | (2006.01) |
| ***D21H 27/40*** | (2006.01) |
| ***D21H 27/00*** | (2006.01) |
| *D21H 11/04* | (2006.01) |

(52) U.S. Cl.

CPC ..... *D21H 27/30* (2013.01); *D21H 27/005* (2013.01); *D21H 27/40* (2013.01); *D21H 11/04* (2013.01)

(58) Field of Classification Search

CPC .... D21H 27/002; D21H 27/40; D21H 27/30; D21H 27/005

See application file for complete search history.

(56) References Cited

U.S. PATENT DOCUMENTS

| | | | | |
|---|---|---|---|---|
| 4,100,017 | A | 7/1978 | Flautt, Jr. | |
| 4,300,981 | A | 11/1981 | Carstens | |
| 5,830,558 | A | 11/1998 | Barnholtz | |
| 5,906,711 | A | 5/1999 | Barnholtz | |
| 6,200,419 | B1 * | 3/2001 | Phan | B29C 39/18 162/109 |
| 6,420,013 | B1 | 7/2002 | Vinson et al. | |
| 6,602,387 | B1 | 8/2003 | Loughran et al. | |
| 6,649,025 | B2 | 11/2003 | Mills et al. | |
| 6,893,535 | B2 * | 5/2005 | Hermans | D21F 11/14 162/109 |
| 7,303,650 | B2 | 12/2007 | Hermans et al. | |

(Continued)

FOREIGN PATENT DOCUMENTS

| | | |
|---|---|---|
| EP | 0938612 B1 | 2/2004 |
| EP | 0938610 B1 | 1/2005 |

OTHER PUBLICATIONS

McDonough et al., Factors Affecting the Outlook for Utilization of Hardwoods in Pulping and Papermaking, May 1985, IPC technical Paper Series, No. 154, whole document.*

*Primary Examiner* — Anthony Calandra
(74) *Attorney, Agent, or Firm* — Kimberly-Clark Worldwide, Inc.

(57) ABSTRACT

The invention provides a multi-ply tissue product having different surface characteristics on each side of the product. The multi-ply tissue product may be formed from two or more plies where one surface is formed by a substantially smooth creped ply and the other surface is formed by a textured through-air dried ply. In this manner the tissue product may be used for both personal care, which requires a soft and smooth surface, and general household wiping, which requires a rough, durable surface.

17 Claims, 1 Drawing Sheet

(56) References Cited

U.S. PATENT DOCUMENTS

| | | | | |
|---|---|---|---|---|
| 7,422,658 | B2 | 9/2008 | Hermans et al. | |
| RE40,724 | E | 6/2009 | Barnholtz | |
| 8,236,135 | B2 * | 8/2012 | Prodoehl | B32B 5/26 162/125 |
| 8,481,133 | B2 | 7/2013 | Hermans et al. | |
| 2003/0000666 | A1 | 1/2003 | Mansson et al. | |
| 2003/0215602 | A1 | 11/2003 | Andersson et al. | |
| 2005/0022955 | A1 | 2/2005 | Ward et al. | |
| 2011/0008631 | A1 | 1/2011 | Lindqvist | |
| 2013/0269892 | A1 | 10/2013 | Pawar et al. | |

* cited by examiner

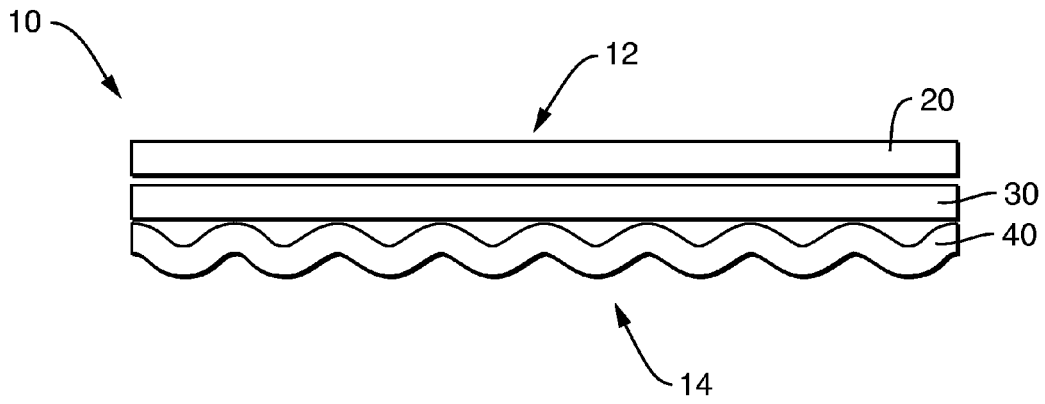
10
12
20
30
40
14

TWO SIDED MULTI-PLY TISSUE PRODUCT

RELATED APPLICATIONS

The present application is a national-phase entry, under 35 U.S.C. §371, of PCT Patent Application No. PCT/US2014/012856, filed on Jan. 24, 2014, which is incorporated herein by reference in a manner consistent with the instant application.

BACKGROUND

Tissue products such as facial tissue, bath tissue, paper towels, industrial wipers, and the like are designed to provide several important properties. For example, the products should have good bulk characteristics and a soft feel. The products should be highly absorbent to fluids, including bodily fluids. In many cases, the products need good strength even after they become wet. Some products require a high resistance to tearing. Small changes in the structure or manufacturing processes of such products can provide a profound impact on the ultimate sensation to the user. Attempts have been made in the past to enhance and increase the physical characteristics of multi-ply tissue products.

Traditionally multi-ply tissue products employ plies that are structurally similar and manufactured using similar papermaking techniques. In certain instances, however, attempts have been made to form multi-ply products from heterogeneous plies. Generally these products are formed using a ply that while providing some beneficial property, is not suitable for contact with the user and therefore must be disposed in the center of a three ply product. For example, U.S. Pat. No. 4,738,847 to Rothe et al. discloses a multi-ply tissue product where the middle ply of a three ply product comprises a virucidal. The virucidal containing ply is disposed in the middle ply, away from the surface, to avoid contact with the user's skin. Similarly, U.S. Pat. No. 7,497,923 to Ward et al. discloses a multi-ply tissue product where the middle ply of a three ply product comprises an uncreped through-air dried ply disposed between two smoother creped plies. In this manner, the uncreped ply provides bulk but does not compromise the softness of the product because it is not brought into contact with the user in use. While these products provide certain benefits to the user, they lack differing surface textures, which limits their usefulness.

In other instances, the prior art has attempted to improve tissue product absorbency by providing a multi-ply tissue product with an absorbent core in the center, such as provided in U.S. Pat. No. 5,919,556 to Barnholtz. The stated goal of such tissues is increased absorbency by providing a three ply tissue product in which the center ply comprises a more dense, thinner ply. While such products generally have improved absorbency, the dense, thin middle layers compromise softness and fail to provide the user with differing surface textures for different applications.

Thus, there remains a need in the art for a tissue product having two different surface characteristics. More specifically there is a need in the art for a multi-ply tissue product having a substantially smooth first surface for contact with a user's skin and a second textured surface for wiping and scrubbing applications.

SUMMARY

It has now been surprisingly discovered that the most effective and efficient means of forming a tissue product having different surface characteristics is to combine one substantially smooth tissue ply, such as a creped tissue ply, and one textured tissue ply, such as a through-air dried ply. In this manner the resulting tissue product has two surfaces with different textures and may be used for both personal care, which requires a soft and smooth surface, and general household wiping, which requires a textured, durable surface.

Accordingly, in one embodiment the present invention provides a multi-ply tissue product having a top and a bottom surface wherein the Surface Smoothness Ratio is greater than about 1.4.

In another embodiment the present invention provides a multi-ply tissue product having a top and a bottom surface wherein the Surface Smoothness Ratio is greater than about 1.4 and the tissue product has a sheet bulk greater than about 9 cc/g and a geometric mean tensile (GMT) greater than about 1,000 g/3".

In yet another embodiment the present invention provides a multi-ply tissue product having a top and a bottom surface wherein the Surface Smoothness Ratio is greater than about 1.4 and the tissue product has a sheet caliper greater than about 500 μm and a geometric mean tensile (GMT) greater than about 1,000 g/3".

In still another embodiment the present invention provides a three ply tissue product having a top and a bottom surface comprising a first creped ply, a second creped ply and a through-air dried ply, wherein the second creped ply is disposed between the first creped ply and the through-air dried ply and wherein the Surface Smoothness Ratio is greater than about 1.4.

In yet another embodiment the present invention provides a three ply tissue product comprising a first, a second and a third ply, where the first ply forms a first surface of the tissue product and the third ply forms a second surface of the tissue product, wherein the first surface has a Surface Smoothness of about 0.006 or less and the second surface has a Surface Smoothness of about 0.009 or greater.

DESCRIPTION OF THE DRAWINGS

FIG. 1 illustrates one embodiment of the invention comprising a three ply tissue product.

DEFINITIONS

As used herein, the term "tissue product" refers to products made from tissue webs and includes, bath tissues, facial tissues, paper towels, industrial wipers, foodservice wipers, napkins, medical pads, and other similar products.

As used herein, the terms "tissue web" and "tissue sheet" refer to a fibrous sheet material suitable for forming a tissue product.

As used herein the term "ply" refers to a discrete product element. Individual plies may be arranged in juxtaposition to each other. The term may refer to a plurality of web-like components such as in a multi-ply facial tissue, bath tissue, paper towel, wipe, or napkin.

As used herein, the term "basis weight" generally refers to the bone dry weight per unit area of a tissue and is generally expressed as grams per square meter (gsm). Basis weight is measured using TAPPI test method T-220.

As used herein, the term "geometric mean tensile" (GMT) refers to the square root of the product of the machine direction tensile and the cross-machine direction tensile of the web, which are determined as described in the Test Method section.

As used herein, the term "caliper" is the representative thickness of a single sheet (caliper of tissue products comprising two or more plies is the thickness of a single sheet of tissue product comprising all plies) measured in accordance with TAPPI test method T402 using an EMVECO 200-A Microgage automated micrometer (EMVECO, Inc., Newberg, Oreg.). The micrometer has an anvil diameter of 2.22 inches (56.4 mm) and an anvil pressure of 132 grams per square inch (per 6.45 square centimeters) (2.0 kPa).

As used herein, the term "sheet bulk" refers to the quotient of the caliper (μm) divided by the bone dry basis weight (gsm). The resulting sheet bulk is expressed in cubic centimeters per gram (cc/g).

As used herein, the term "slope" refers to slope of the line resulting from plotting tensile versus stretch and is an output of the MTS TestWorks™ in the course of determining tensile strength as described in the Test Methods section. Slope is reported in the units of kilograms (kg) per unit of sample width (inches) and is measured as the gradient of the least-squares line fitted to the load-corrected strain points falling between a specimen-generated force of 70 to 157 grams (0.687 to 1.540 N) divided by the specimen width. Slopes are generally reported herein as having units of kg/3".

As used herein, the term "geometric mean slope" (GM Slope) generally refers to the square root of the product of machine direction slope and cross-machine direction slope. GM Slope generally is expressed in units of kg/3" or g/3".

As used herein, the term "Stiffness Index" refers to the quotient of the geometric mean slope (having units of g/3") divided by the geometric mean tensile strength (having units of g/3").

As used herein, the term "Surface Smoothness" refers to square root of the product of machine direction mean deviation of MIU (MMD) and cross direction MMD, measured as described in the Test Methods section below.

As used herein, the term "Surface Smoothness Ratio" refers to Surface Smoothness of the second surface of a tissue product, the tissue surface having the highest Surface Smoothness of the two tissue surfaces, divided by the Surface Smoothness of the first surface of the tissue product, the tissue surface having the lowest Surface Smoothness of the two tissue surfaces.

DETAILED DESCRIPTION

The two sided multi-ply tissue product of the present invention comprises at least two plies having different surface characteristics such as one ply that is substantially smooth and another ply that is textured. In a particularly preferred embodiment the two sided multi-ply tissue product of the present invention comprises a substantially smooth ply, such as a creped tissue ply, forming a first surface of the tissue product and a textured tissue ply, such as a through-air dried ply, forming the second surface of the tissue product. In this manner the first surface of the tissue product has a Surface Smoothness of about 0.006 or less and the second surface of the tissue product has a Surface Smoothness of about 0.009 or greater. The dual texture provides a tissue product that may be used in several different applications.

In one particularly preferred embodiment the two sided tissue product of the present invention comprises at least three plies, where one of the plies is a through-air dried ply and at least one ply is a creped ply, where the through-air dried ply forms one of the outer surfaces of the product and the creped ply forms the other.

Referring now to FIG. 1, one embodiment of a tissue product 10 comprising a first 20, second 30 and third 40 ply is illustrated. The second ply 30 is disposed between the first 20 and third 40 plies. The first ply 20 has a top surface which forms the first surface 12 of the tissue product 10. The second outer ply 40 has a bottom surface which forms the second surface 14 of the tissue product.

In the illustrated embodiment the first outer ply 20 comprises a tissue ply that is substantially smooth. Generally, when a tissue ply is referred to herein as being substantially smooth, the tissue ply has at least one surface having a Surface Smoothness less than about 0.006 and more preferably less than about 0.0055. In a preferred embodiment the first outer ply is a creped tissue ply. The second ply 30 also comprises a tissue ply that is substantially smooth and in a preferred embodiment is also a creped tissue ply and is substantially similar to the first ply 20. Unlike the first 20 and second 30 plies, the third ply 40 is a textured tissue ply. In a particularly preferred embodiment the third ply 40 is a through-air dried tissue ply and in a particularly preferred embodiment an uncreped through-air dried tissue ply.

Constructing a multi-ply tissue product in this manner provides a tissue that has two different surface characteristics as well as good bulk, tensile strength and low stiffness. The combination of these properties is not found in the prior art, as summarized below.

TABLE 1

| Tissue Product | No. Plies | Surface Smoothness Ratio | Sheet Bulk (cc/g) | GMT (g/3") | GM Slope (kg/3") | Stiffness Index |
|---|---|---|---|---|---|---|
| U.S. Pat. No. 7,497,923 Prior Art | 3 | 1.05 | 10.5 | 1024 | 13.84 | 13.52 |
| U.S. Pat. No. 6,649,025 Prior Art | 2 | 1.33 | 8.1 | 992 | 12.23 | 12.33 |
| Quilted Northern Ultra Soft & Strong | 2 | 1.01 | 11.6 | 884 | 6.87 | 7.76 |
| Charmin Ultra Strong Bath Tissue | 2 | 1.14 | 13.8 | 1161 | 9.66 | 8.32 |
| Inventive | 3 | 1.96 | 9.0 | 1063 | 14.98 | 14.09 |
| Inventive | 3 | 1.90 | 10.1 | 1080 | 13.84 | 12.82 |
| Inventive | 3 | 1.45 | 8.8 | 1261 | 13.55 | 10.75 |
| Inventive | 3 | 1.51 | 9.7 | 980 | 13.09 | 13.36 |

The instant multi-ply tissue product may be constructed from two or more plies that are manufactured using the same or different tissue making techniques. In a particularly preferred embodiment the multi-ply tissue product comprises three plies where the first and second plies are manufactured by the same tissue manufacturing process, such as creped wet pressed, and the third ply is manufactured using a different process, such as creped through-air dried (CTAD) or uncreped through-air dried (UCTAD).

In a particularly preferred embodiment the tissue product comprises one or more substantially smooth tissue plies, which may be produced using one of the creped tissue making processes known in the art. For example, creped tissue webs may be formed using either a wet pressed or modified wet pressed process such as those disclosed in U.S. Pat. Nos. 3,953,638, 5,324,575 and 6,080,279, the disclosures of which are incorporated herein in a manner consistent with the instant application. In these processes the embryonic tissue web is transferred to a Yankee dryer, which completes the drying process, and then creped from the Yankee surface using a doctor blade or other suitable device.

In addition to a substantially smooth ply the tissue product comprises a textured tissue ply. The textured tissue ply may be a creped through-air dried (CTAD) tissue; uncreped through-air dried (UCTAD) tissue; a textured tissue, made using a process including the step of using pressure, vacuum, or air flow through the wet web (or a combination of these) to conform the wet web into a shaped fabric and subsequently drying the shaped sheet using a Yankee dryer, or series of steam heated dryers, or some other means, including but not limited to tissue made using the ATMOS process developed by Voith or the NTT process developed by Metso; or fabric creped tissue, made using a process including the step of transferring the wet web from a carrying surface (belt, fabric, felt, or roll) moving at one speed to a fabric moving at a slower speed (at least 5% slower) and subsequently drying the sheet. Those skilled in the art will recognize that these processes are not mutually exclusive, e.g., an uncreped TAD process may include a fabric crepe step in the process.

Particularly preferred textured tissue plies are formed by through-air dried process known in the art. In such processes the embryonic web is noncompressive dried. For example, textured tissue plies may be formed by either creped or uncreped through-air dried processes. Particularly preferred are uncreped through-air dried webs, such as those described in U.S. Pat. No. 5,779,860, the contents of which are incorporated herein in a manner consistent with the present disclosure.

Suitable textured tissue webs may also include embossed, microembossed, and microstrained tissue webs. Suitable techniques for embossing tissues are well known in the art such as those disclosed in U.S. Pat. Nos. 5,409,572 and 5,693,406, the contents of which are incorporated herein in a manner consistent with the present disclosure.

Regardless of the tissue making process used to produce the individual plies, the resulting multi-ply tissue product has a first surface that is substantially smooth and a second surface that is textured such that the Surface Smoothness Ratio is greater than about 1.4, such as from about 1.4 to about 2.2, and more preferably from about 1.6 to about 2.0.

When forming the multi-ply tissue products of the present invention substantially smooth plies, such as the first ply, generally have a basis weight less than about 40 gsm, such as from about 10 to about 30 gsm, and more preferably from about 14 to about 20 gsm. Further, the first outer ply and middle ply generally have a sheet bulk greater than about 5 cc/g, such as from about 5 to about 15 cc/g, and more preferably from about 7 to about 10 cc/g.

In addition to having the foregoing basis weights and sheet bulks, the substantially smooth plies have a geometric mean tensile (GMT) greater than about 500 g/3", such as from about 500 to about 1,000 g/3", and more preferably from about 600 to about 800 g/3". At these tensile strengths the substantially smooth plies have relatively low geometric mean modulus, expressed as GM Slope, so as to not overly stiffen the tissue product. Accordingly, in certain embodiments the substantially smooth plies have GM Slope less than about 18 kg/3", such as from about 10 to about 18 kg/3", and more preferably from about 12 to about 15 kg/3".

The textured tissue ply generally has a basis weight less than about 60 gsm, such as from about 20 to about 60 gsm, and more preferably from about 30 to about 50 gsm. The textured tissue ply generally has a sheet bulk greater than about 8 cc/g, such as from about 8 to about 20 cc/g, and more preferably from about 10 to about 18 cc/g.

In addition to having the foregoing basis weights and sheet bulks, the textured tissue ply generally has a GMT greater than about 500 g/3", such as from about 500 to about 1,200 g/3", and more preferably from about 700 to about 1,000 g/3". At these tensile strengths the textured tissue ply generally has a GM Slope less than about 12 kg/3", such as from about 6 to about 12 kg/3", and more preferably from about 8 to about 10 kg/3".

Generally the foregoing individual plies are joined together using any ply attachment means known in the art, such as mechanical crimping, adhesive, or embossing. Crimping is particularly preferred ply attachment means as it avoids the over stiffening of the tissue product often associated with adhesive ply attachment and does not impart any additional texture to the product as is often the case with embossing.

When plies having differing texture are joined together the resulting multi-ply tissue product generally has a basis weight greater than about 40 gsm, such as from about 40 to about 80 gsm, and more preferably from about 50 to about 60 gsm. At these basis weights the tissue products generally have calipers greater than about 400 μm, such as from about 400 to about 600 μm, and more preferably from about 450 to about 550 μm. The tissue products further have sheet bulks greater than about 7.0 cc/g, such as from about 8.0 to about 20.0 cc/g, and more preferably from about 10.0 to about 18.0 cc/g.

While being bulky and substantive enough to have multiple applications the tissue products are also strong enough to withstand use, but have relatively low modulus so as not to be overly stiff. For example, in certain embodiments the tissue products have GMT greater than about 800 g/3", such as from about 800 to about 1200 g/3", and more preferably from about 900 to about 1100 g/3". At these tensile strengths the tissue products generally have GM Slopes less than about 15.0 kg/3", such as from about 10.0 to about 15.0 kg/3", and more preferably from about 12.0 to about 14.0 kg/3".

As noted previously, regardless of the tissue making process used to form the various plies, it is preferred that the composite multi-ply tissue product have a first surface that is substantially smooth and second surface that is textured. For example, in certain embodiments the first surface has a Surface Smoothness less than about 0.0070, such as from about 0.0050 to about 0.0070, and more preferably from about 0.0055 to about 0.0065. Meanwhile the second surface has a Surface Smoothness greater than about 0.0075, such as from about 0.0075 to about 0.0120, and more preferably from about 0.0080 to about 0.0110. In this manner the tissue product of the present invention has a Surface Smoothness Ratio greater than about 1.4, such as from about 1.4 to about 2.0, and more preferably from about 1.5 to about 1.8. Thus, compared to multi-ply tissue products of the prior art the instant two sided tissue products have markedly different surface properties on the first and the second sides, as illustrated in Table 2, below.

TABLE 2

| Tissue Product | No. Plies | First Surface Smoothness | Second Surface Smoothness | Surface Smoothness Ratio |
|---|---|---|---|---|
| U.S. Pat. No. 7,497,923 Prior Art | 3 | 0.0066 | 0.0069 | 1.05 |
| U.S. Pat. No. 6,649,025 Prior Art | 2 | 0.0067 | 0.0089 | 1.33 |
| Bounty Towels | 2 | 0.0191 | 0.0203 | 1.06 |
| Bounty Extra Soft Towels | 2 | 0.0093 | 0.0114 | 1.23 |

TABLE 2-continued

| Tissue Product | No. Plies | First Surface Smoothness | Second Surface Smoothness | Surface Smoothness Ratio |
|---|---|---|---|---|
| Charmin Ultra Strong Bath Tissue | 2 | 0.0098 | 0.0112 | 1.14 |
| Quilted Northern Ultra Soft & Strong | 2 | 0.0090 | 0.0091 | 1.01 |
| Inventive | 3 | 0.0062 | 0.0118 | 1.90 |
| Inventive | 3 | 0.0058 | 0.0099 | 1.71 |
| Inventive | 3 | 0.0059 | 0.0115 | 1.95 |

TEST METHODS

Surface Smoothness

The surface properties of samples were measured on KES Surface Tester (Model KE-SE, Kato Tech Co., Ltd., Kyoto, Japan). For each sample the surface smoothness was measured according to the Kawabata Test Procedures with samples tested along MD and CD and on both sides for five repeats with a sample size of 10 cm×10 cm. Care was taken to avoid folding, wrinkling, stressing, or otherwise handling the samples in a way that would deform the sample. Samples were tested using a multi-wire probe of 10 m×10 mm consisting of 20 piano wires of 0.5 mm in diameter each with a contact force of 25 grams. The test speed was set at 1 mm/s. The sensor was set at "H" and FRIC was set at "DT". The data was acquired using KES-FB System Measurement Program KES-FB System Ver 7.09 E for Win98/2000/XP by Kato Tech Co., Ltd., Kyoto, Japan. The selection in the program was "KES-SE Friction Measurement".

KES Surface Tester determined the coefficient of friction (MIU) and mean deviation of MIU (MMD), where higher values of MIU indicate more drag on the sample surface and higher values of MMD indicate more variation or less uniformity on the sample surface.

The values MIU and MMD are defined by:

$$MIU(\bar{\mu})=1/X\int_0^x \mu dx$$

$$MMD=1/X\int_0^x |\mu-\bar{\mu}| dx$$

where $\mu$=friction force divided by compression force $\bar{\mu}$=mean value of $\mu$ x=displacement of the probe on the surface of specimen, cm X=maximum travel used in the calculation, 2 cm The cross machine (CD) and machine direction (MD) MMD values of the top and bottom surface of each tissue product sample was tested five times. The results of five sample measurements were averaged and reported as the MMD-CD and MMD-MD. The square root of the product of MMD-CD and MMD-MD was reported as Surface Smoothness.

Tensile

Samples for tensile strength testing are prepared by cutting a 3" (76.2 mm)×5" (127 mm) long strip in either the machine direction (MD) or cross-machine direction (CD) orientation using a JDC Precision Sample Cutter (Thwing-Albert Instrument Company, Philadelphia, Pa., Model No. JDC 3-10, Ser. No. 37333). The instrument used for measuring tensile strengths is an MTS Systems Sintech 11S, Serial No. 6233. The data acquisition software is MTS TestWorks™ for Windows Ver. 4 (MTS Systems Corp., Research Triangle Park, N.C.). The load cell is selected from either a 50 or 100 Newton maximum, depending on the strength of the sample being tested, such that the majority of peak load values fall between 10 and 90 percent of the load cell's full scale value. The gauge length between jaws is 4±0.04 inches. The jaws are operated using pneumatic-action and are rubber coated. The minimum grip face width is 3" (76.2 mm), and the approximate height of a jaw is 0.5 inches (12.7 mm). The crosshead speed is 10±0.4 inches/min (254±1 mm/min), and the break sensitivity is set at 65 percent. The sample is placed in the jaws of the instrument, centered both vertically and horizontally. The test is then started and ends when the specimen breaks. The peak load is recorded as either the "MD tensile strength" or the "CD tensile strength" of the specimen depending on the sample being tested. At least six representative specimens are tested for each product, taken "as is," and the arithmetic average of all individual specimen tests is either the MD or CD tensile strength for the product.

EXAMPLES

Two and three ply tissue products were made from various tissue webs, prepared as described below. The tissue products were formed by plying various webs together, calendering and crimping the plied products. Both inventive and prior art tissue products were produced to assess surface smoothness and physical properties. Prior art tissue products consisted of two-ply tissue products (one ply CTEC and one ply UCTAD) prepared as described in U.S. Pat. No. 6,649,025 and three-ply tissue products (one ply UCTAD disposed between two plies CTEC) as described in U.S. Pat. No. 7,497,923.

Creped Tissue Webs

Creped tissue webs were made using a conventional wet pressed tissue-making process on a pilot scale tissue machine. Initially, northern softwood kraft (NSWK) pulp was dispersed in a pulper for 30 minutes at about 4 percent consistency at about 100° F. The NSWK pulp was then transferred to a dump chest and subsequently diluted with water to approximately 2 percent consistency. Softwood fibers were then pumped to a machine chest. Generally the softwood fibers were added to the middle layer in the 3-layer tissue structure.

Eucalyptus hardwood kraft (EHWK) pulp was dispersed in a pulper for 30 minutes at about 4 percent consistency at about 100° F. The EHWK pulp was then transferred to a dump chest and diluted to about 2 percent consistency. The EHWK pulp was then pumped to a machine chest. Generally the EHWK fibers were added to the dryer and felt layers of the 3-layer sheet structure.

The pulp fibers from the machine chests were pumped to the headbox at a consistency of about 0.1 percent. Pulp fibers from each machine chest were sent through separate manifolds in the headbox to create a 3-layered tissue structure having a furnish split of 44 wt % EHWK/32 wt % NBSK/24 wt % EHWK. The fibers were deposited onto a felt using a Crescent Former.

The wet sheet, about 10 to 20 percent consistency, was adhered to a Yankee dryer via a pressure roll. The consistency of the wet sheet after the pressure roll nip (post-pressure roll consistency or PPRC) was approximately 40 percent. The wet sheet is adhered to the Yankee dryer due to the additive composition that is applied to the dryer surface. A spray boom situated underneath the Yankee dryer sprayed the creping composition, described in the present disclosure, onto the dryer surface at addition levels of about 10 mg/m$^2$. The creping composition comprised 71 percent Crepetrol A9915 and 29 percent Rezosol 6601 (both available from Ashland, Inc., Wilmington Del.).

Uncreped Through-Air Dried Webs

Tissue webs for use on the outer ply of a multi-ply tissue product were produced using a through-air dried papermaking process commonly referred to as "uncreped through-air dried" ("UCTAD") and generally described in U.S. Pat. No. 5,607,551, the contents of which are incorporated herein in a manner consistent with the present disclosure. Base sheets with a target bone dry basis weight of about 44 grams per square meter (gsm) were produced. The base sheets were then converted and spirally wound into rolled tissue products.

In all cases the base sheets were produced from a furnish comprising northern softwood kraft and eucalyptus kraft using a layered headbox fed by three stock chests such that the webs having three layers (two outer layers and a middle layer) were formed. The two outer layers comprised eucalyptus and the middle layer comprised softwood. The 3-layered tissue structure had a furnish split of 33 wt % EHWK/34 wt % NBSK/33 wt % EHWK.

The tissue web was formed on a Voith Fabrics TissueForm V forming fabric, vacuum dewatered to approximately 25 percent consistency and then subjected to rush transfer (approximately 35 percent) when transferred to the transfer fabric. The transfer fabric was the fabric described as "Fred" in U.S. Pat. No. 7,611,607 (commercially available from Voith Fabrics, Appleton, Wis.).

The web was then transferred to a through-air drying fabric. The through-air drying fabric was T-605-1 (commercially available from Voith Fabrics, Appleton, Wis.); T-1205-2 described previously in U.S. Pat. No. 8,500,955; or a silicone printed fabric described previously in co-pending PCT Appl. No. US2013/072220 (referred to herein as "Fozzie"). Transfer to the through-drying fabric was done using vacuum levels of greater than 10 inches of mercury at the transfer. The web was then dried to approximately 98 percent solids before winding.

Creped Through-Air Dried Webs

For tissue webs produced by CTAD, the web was formed on a TissueForm V forming fabric, transferred to a Voith 2164 fabric and vacuum dewatered to roughly 25 percent consistency. The web was then transferred to a t-807-1 TAD fabric (illustrated in FIG. 2, Voith Fabrics, Appleton, Wis.). No rush transfer was utilized at the transfer to the t-807-1 TAD fabric. After the web was transferred to the t-807-1 TAD fabric, the web was dried, however the consistency was maintained low enough to allow significant molding when the web was transferred using high vacuum to the impression fabric described as "Fred" in U.S. Pat. No. 7,611,607, which is incorporated herein in a manner consistent with the present disclosure. A vacuum level of at least 10 inches of mercury was used for the transfer to the impression fabric in order to mold the web as much as possible into the fabric. The web was then transferred to a Yankee dryer and creped. Minimum pressure was used at the web transfer to minimize compaction of the web during the transfer to the Yankee dryer so as to maintain maximum web caliper.

An adhesive formulation of polyvinyl alcohol, PAE resin and non-oil based release agent was used for creping. The adhesive composition and add on rates were typical for standard creped throughdried tissue. The sheet was dried to a very high level (less than about 2 percent moisture) on the Yankee dryer to maximize bulk in the creping process. High web tension between the Yankee and the reel was maintained to prevent sheet wrinkling.

Multi-Ply Tissue Products

Various two and three ply tissue products were prepared from the tissue webs prepared as described above. The composition of the various tissue products is summarized in Table 3, below. To produce the multi-ply tissue products, tissue web soft rolls were rewound, calendared between two steel rolls and plied together. Mechanical crimping on the edges of the structure held the plies together. The plied sheet was then slit on the edges to a standard width of approximately 8.5 inches, folded, and cut to facial tissue length. Tissue samples were conditioned and tested. The results of the testing are summarized in Tables 4 and 5, below.

TABLE 3

| Sample | Plies | Tissue Product Structure | UCTAD Fabric | UCTAD BW (gsm) | CTAD BW (gsm) | CTEC BW (gsm) | Calender (pli) |
|---|---|---|---|---|---|---|---|
| 1 | 3 | CTEC/UCTAD/CTEC | T-605-1 | 30.0 | — | 14.2 | 135 |
| 2 | 2 | CTEC/UCTAD | T-605-1 | 45.0 | — | 14.2 | 135 |
| 3 | 3 | CTEC/CTEC/UCTAD | T1205-2 | 30.0 | — | 14.2 | 135 |
| 4 | 3 | CTEC/CTEC/UCTAD | T1205-2 | 22.0 | — | 14.5 | 135 |
| 5 | 3 | CTEC/CTEC/UCTAD | T-605-1 | 45.0 | — | 17.5 | 170 |
| 6 | 3 | CTEC/CTEC/TAD | — | — | 29.4 | 14.2 | 135 |
| 7 | 3 | CTEC/CTEC/UCTAD | Fozzie | 30.0 | — | 14.2 | 40 |

TABLE 4

| Sample | BW (gsm) | Caliper (μm) | Sheet Bulk (cc/g) | GMT (g/3") | GM Slope (kg/3") | Stiffness Index |
|---|---|---|---|---|---|---|
| 1 | 52.3 | 551 | 10.5 | 1024 | 13.84 | 13.52 |
| 2 | 55.4 | 447 | 8.1 | 992 | 12.23 | 12.33 |
| 3 | 53.7 | 467 | 8.1 | 1058 | 14.79 | 13.98 |
| 4 | 46.6 | 448 | 9.0 | 1063 | 14.98 | 14.09 |
| 5 | 53.2 | 538 | 10.1 | 1080 | 13.84 | 12.82 |
| 6 | 52.6 | 461 | 8.8 | 1261 | 13.55 | 10.75 |
| 7 | 50.5 | 488 | 9.7 | 980 | 13.09 | 13.36 |

TABLE 5

| Sample | Top Surface Smoothness | Bottom Surface Smoothness | Surface Smoothness Ratio |
|---|---|---|---|
| 1 | 0.0066 | 0.0069 | 1.05 |
| 2 | 0.0067 | 0.0089 | 1.33 |
| 3 | 0.0058 | 0.0099 | 1.69 |
| 4 | 0.0059 | 0.0115 | 1.96 |
| 5 | 0.0062 | 0.0118 | 1.90 |
| 6 | 0.0058 | 0.0084 | 1.45 |
| 7 | 0.0061 | 0.0091 | 1.51 |

We claim:

1. A three ply tissue product having a top and a bottom surface, the tissue product comprising a first creped ply, a second creped ply and a through-air dried ply, wherein the second creped ply is disposed between the first creped ply and the through-air dried ply and wherein the Surface Smoothness Ratio is greater than about 1.4 and having a GMT from about 500 to about 1,200 g/3", a sheet bulk from about 8 to about 20 cc/g and a basis weight from about 40 to about 80 gsm.

2. The tissue product of claim 1 wherein the through-air dried ply is a creped through-air dried ply.

3. The tissue product of claim 1 wherein the through-air dried ply is an uncreped through-air dried ply.

4. The tissue product of claim 1 wherein the first and the second creped plies are substantially identical.

5. The tissue product of claim 1 wherein the first and the second creped plies having a Surface Smoothness less than about 0.006.

6. The multi-ply tissue product of claim 1 wherein the Surface Smoothness Ratio is from about 1.5 to about 2.0.

7. The tissue product of claim 1 wherein the first and the second creped plies have a basis weight from about 14 to about 20 gsm and a sheet bulk from about 7 to about 10 cc/g.

8. The tissue product of claim 1 wherein the first and the second creped plies have a GMT from about 600 to about 800 g/3" and a Geometric Mean Slope (GM Slope) from about 12 to about 15 kg/3".

9. The tissue product of claim 1 wherein the through-air dried ply has a basis weight from about 30 to about 50 gsm and a sheet bulk from about 10 to about 18 cc/g.

10. The tissue product of claim 1 wherein the through-air dried ply has a GMT from about 700 to about 1,000 g/3" and a GM Slope from about 6 to about 12 kg/3".

11. The tissue product of claim 1 wherein the first, second and third plies are joined together by a ply attachment means selected from the group consisting of mechanical crimping, adhesive, or embossing.

12. The tissue product of claim 1 wherein the second surface has a Surface Smoothness from about 0.0075 to about 0.0120 and the product has a Surface Smoothness Ratio from about 1.5 to about 1.8.

13. A three ply tissue product comprising a first, a second and a third ply, where the first ply forms a first surface of the tissue product and the third ply forms a second surface of the tissue product, wherein the first surface has a Surface Smoothness of about 0.006 or less and the second surface has a Surface Smoothness of about 0.009 or greater and having a GMT from about 500 to about 1,200 g/3", a sheet bulk from about 8 to about 20 cc/g and a basis weight from about 40 to about 80 gsm.

14. The tissue product of claim 13 wherein the third ply is a creped through-air dried ply.

15. The tissue product of claim 13 wherein third ply is an uncreped through-air dried ply.

16. The tissue product of claim 13 wherein the first and the second creped plies have a Surface Smoothness less than about 0.006.

17. The tissue product of claim 13 wherein the Surface Smoothness Ratio is from about 1.5 to about 2.0.

* * * * *